US010335822B1

(12) United States Patent
Shoemaker, Sr.

(10) Patent No.: US 10,335,822 B1
(45) **Date of Patent: *Jul. 2, 2019**

(54) SHOWERHEAD DIRECTIONAL CONTROL APPARATUS

(71) Applicant: David P. Shoemaker, Sr., Quakertown, PA (US)

(72) Inventor: David P. Shoemaker, Sr., Quakertown, PA (US)

( * ) Notice: Subject to any disclaimer, the term of this patent is extended or adjusted under 35 U.S.C. 154(b) by 7 days.

This patent is subject to a terminal disclaimer.

(21) Appl. No.: 15/641,984

(22) Filed: Jul. 5, 2017

Related U.S. Application Data

(63) Continuation-in-part of application No. 14/015,839, filed on Aug. 30, 2013, now Pat. No. 9,694,370.

(60) Provisional application No. 61/694,815, filed on Aug. 30, 2012.

(51) Int. Cl.

| | |
|---|---|
| ***A47K 3/00*** | (2006.01) |
| ***B05B 15/68*** | (2018.01) |
| ***B05B 1/18*** | (2006.01) |
| ***E03C 1/04*** | (2006.01) |
| ***B05B 15/65*** | (2018.01) |
| *B05B 1/00* | (2006.01) |

(52) U.S. Cl.
CPC ..... *B05B 15/68* (2018.02); *B05B 1/18* (2013.01); *B05B 15/65* (2018.02); *E03C 1/0408* (2013.01); *B05B 1/00* (2013.01)

(58) Field of Classification Search
CPC ..... A47K 3/281; B05B 1/185
USPC ..... 4/615, 607; 239/289
See application file for complete search history.

(56) References Cited

U.S. PATENT DOCUMENTS 4,360,160 A * 11/1982 Jette ..... B05B 1/3026 239/289
6,474,621 B1 * 11/2002 Vogel ..... E03C 1/041 137/382

* cited by examiner

*Primary Examiner* — Lauren A Crane
(74) *Attorney, Agent, or Firm* — Clinton H. Wilkinson; Charles A. Wilkinson

(57) ABSTRACT

A showerhead directional control assembly for enabling physically challenged persons to easily adjust the direction of water spray emitted from a showerhead while seated on a chair in a shower or tub installation including a handle section which is pivotably secured to a mounting section connected to a showerhead assembly, the handle being securable in an extended use position in close proximity to the user, and in an embodiment having an internal construction for locking the handle section to the mounting section in an extended position, and which arm may be pivoted to an non-use position which does not obstruct use of the shower by non-disabled persons, the apparatus further including an adjustable bracket for supporting the handle assembly on a water supply pipe and enabling more precise adjustment of the location of the handle in an extended position.

10 Claims, 8 Drawing Sheets

SHOWERHEAD DIRECTIONAL CONTROL APPARATUS

BACKGROUND OF THE INVENTION

1. Field of the Invention

This invention relates generally to shower control arrangements, and more particularly to controls for showers usable by the disabled and particularly by persons who must be seated while showering.

2. Preliminary Discussion and Description of Related Art

Showering rather than taking baths has become the norm for the American public to the extent that one almost never, or, at least, hardly ever, hears an individual state "I took a bath" or "I am going to take a bath". Instead, the speaker almost invariably states "I took a shower" or "will take a shower". Showers are now indeed ubiquitous with the American public. Yet, for those who are physically handicapped by leg, hip, balance or certain neurological impediments preventing them from standing and from moving around sufficiently or sufficiently easily to expose various portions of their body to the spray of water from a showerhead or shower installation, or who are too unsteady on their feet or slow to recover their balance after a minor slip or unsteadiness, the process of showering can be formidable unless such persons have the aid of another party such as a mate, relative, nursing aid or the like.

Yet many, if not most, disabled persons prefer, like nearly everyone else, to shower in private, even though they may have difficulty in getting into or out of the shower installation, particularly where as in most older homes the shower is a combined full bathroom facility in an upstairs location, frequently attached to a master bedroom or in a downstairs bathroom or the like. In some cases, there may not be room for a disabled person to be able to sit down in a plastic chair or on other specially designed shower seat of a type available on the market (usually placed on the bottom surface of a tub, straddling the sides of the tub, or the like) to facilitate bathing by the disabled, preferably by showering. Even further, if the disabled person is unable to stand without aid, either due to lack of strength, lack of balance or disabling injuries to their legs and hips or back, they have no alternative but to sit during showering. Otherwise, if an aid must be present to help support them in a standing position while showering, which, as pointed out above many persons consider an invasion of privacy and demeaning because an indication of a severe lack of independence, not to mention difficult for the person aiding the disabled in showering. Having another present during the actual process of showering also removes a large part of the usual relaxation and mental stimulation attained when showering as the result of massage of the body surface by stimulating hot liquids.

The usual shower installation is designed for use by persons standing in the shower, with the attainable angle of the showerhead being adapted for best spraying water on the body of an individual standing upright. In addition, the controls of the shower are usually secured to the wall of the shower stall in a position for use by a standing individual. An individual seated in a shower is not positioned, therefore, to readily reach or operate the controls or adjustments of a shower in the typical American shower installation. Furthermore, a seated individual who is disabled is not able to easily twist or turn his or her body to encourage the shower spray to be directed at substantially all parts of at least of his or her upper body, and in addition cannot reach the shower nozzle to adjust the direction of the shower spray manually.

This last problem mentioned above, i.e. directing the shower spray at all parts of the body, is often not as severe for continued use of a shower installation in many other countries as in the United States, since many foreign shower installations, including most European shower installations, are provided with a hand-held showerhead attached to a hose which the user can readily direct to different parts of his or her body. However, the American public is habituated to the use of directionally adjustable, but basically stationary, showerhead mounted on the wall under which the one taking the shower moves to catch the spray of water on various parts of the body. Furthermore, a salient feature of disabled persons and particularly newly disabled persons, which includes those disabled by reason of age, is that such persons prefer to maintain their life as much like their former active state as possible. Thus, while a European or continental hand-held showerhead arrangement could be installed at some expense for the disabled and otherwise physically challenged, and other family members would usually adjust to it, the disabled themselves prefer to maintain their shower installations as much like before as possible and in the United States this involves the usual wall mounted shower head.

As a result of the above considerations, a number of inventors have worked on providing shower arrangements for the disabled including or among which can be noted the patented inventions set forth below. Many of these prior arrangements are difficult for both disabled persons and non-disabled persons to use correctly and consistently. The present inventor, therefore, has developed a pivoting arm arrangement that in an embodiment can be readily attached to a standard showerhead or nozzle structure, which pivoting arm can be easily grasped by a disabled person seated in the shower installation and used to adjust and direct the showerhead to change the direction of the shower spray to reach various parts of such seated disabled person's body, but which pivoting shower adjustment arm can also be pivoted down out of the way of a non-disabled person using the same shower installation. In more advanced embodiments of the invention, the pivoting arm shower control is provided with further control means such as a rotary knob controlling the spray of the showerhead and the relative flow of hot and cold water, the latter being particularly important if there are other users of water in the household such as for flushing toilets, operating clothes or dishwashers or the like at the same time and if a hot water tank-type system is used, and the water may gradually become colder during use in contra distinction to the operation or the intended operation of a demand-type hot water system. In addition, in some embodiments the force of the shower can be varied as well as the force of the water spray adjusted by the same hand controls.

As a result of use of the present invention, a second person need only initially place a plastic or other light chair in the shower if the disabled person is unable to do so, and then aid the disabled showerer into and out of the shower if this is too much for the showerer. Known shower installations for the disabled also frequently have the disadvantage that the controls provided for use by a disabled person are inconvenient for nondisabled persons, so that the convertibility of the shower between use for those who may be disabled and those who may be less physically challenged may be less than desirable. When the arrangement of the present invention is available, in fact, some non- or less-physically challenged persons may prefer to shower while seated using the installation of the invention.

The inventor is aware of the following patent documents relating to shower installations incorporating control arms and/or designed especially for the disabled:

U.S. Pat. No. 3,112,073 issued to C. B. Larson et al. on Nov. 26, 1963, entitled "Flexible Spot Rinsing Head for Shower Baths", discloses a shower head having a standard nozzle and further having separately connected a flexible hose for spot washing or rinsing. A short handle (33) having forward, up, back, and down positions is provided wherein the water supply either flows through the standard nozzle, spot washing hose, both, or neither. Such handle is quite short, however, and clearly is not intended to be reached by a handicapped person who is unable to stand while taking a shower.

U.S. Pat. No. 4,273,289 issued to E. Jette on Jun. 16, 1981 entitled "Showerhead Spray Texture Control", discloses a showerhead wherein the flow of water, direction of spray, and spray texture may be controlled using an elongate rod. The flow or water supply into the showerhead and through a discharge port may be shut off or turned on depending on the angle of the showerhead in relation to the discharge port. A ball structure is provided on the end of the handle which is separate from the elongate rod and includes a sleeve over such rod. The sleeve has a gear on its upper end that is connected to a ring gear on the showerhead, which allows the spray texture to be controlled by turning of the ball.

U.S. Pat. No. 4,282,612 issued to J. L. King on Aug. 11, 1981, entitled "Adjustable Shower and Massage Apparatus", discloses an arrangement that allows the direction of spray emitted from a shower head to be adjusted using a handle means. A plurality of pipe members are pivotally connected together extending generally vertically, with a massage type shower head connected to one pipe member, and handle member connected to a lower pipe member. Movement of the handle causes the angles of the pipes to be adjusted through universal adjustable joints between the individual pipe members, thereby causing the spray angle to also in turn be adjusted.

U.S. Pat. No. 4,311,279 issued to E. Jette on Jan. 19, 1982, entitled "Water Flow Control Device for a Showerhead", is a continuation-in-part application of the '289 Jette patent, and is directed to an alternative showerhead water flow control arrangement. A fitting is threadably connected to the water supply line, a tubular center portion having a swivel means connects the fitting to the showerhead, and a control rod is connected to the fitting. The rod has a valve therein which is aligned with the new main water flow passage through the fitting. By moving the control rod so that it is either aligned or misaligned with the main water flow passage, the rate of water flow may be controlled. As in the earlier Jette patent, the handle can also be used to determine the direction or position of the showerhead.

U.S. Pat. No. 4,398,668 issued to E. Jette on Aug. 16, 1983, entitled "Showerhead Control" is another continuation-in-part application of the previous Jette patents, and discloses a showerhead having a downwardly extending handle connected thereto. This invention includes a shower arm connected to a water supply, a ball valve connecting the shower arm to a showerhead, and a handle connected to the ball valve. Movement of the handle may be used to adjust water flow direction and temperature as well as to shut off the water flow.

U.S. Pat. No. 4,881,282 issued to E. J. George et al. on Nov. 21, 1989, entitled "Adjustable Shower Head", discloses a shower head adjustment means specifically for use by the handicapped. The device is operated by a joystick mounted in the shower assembly within easy reach of one seated in the shower stall, and which joystick is connected to the showerhead by a cable means. Movement of the joystick causes the shower head to move in a like direction as the joystick via four control cables, which are connected to a yoke or panel in the joystick housing.

U.S. Pat. No. 5,220,697 issued to W. T. Birchfield on Jun. 22, 1993, entitled "Handle Assembly for Shower Nozzle Assembly", discloses a shower handle assembly for use by handicapped persons in a shower stall to adjust the height of a shower nozzle, which may be either retrofitted to an existing shower nozzle or used with a new shower nozzle assembly. Birchfield connects a handle assembly over a clamp to a vertically adjustable shower assembly so that one seated on a chair in the shower stall can use the handle to loosen, reposition, and retighten the shower nozzle assembly at a new desired vertical position. Birchfield's invention is not intended to be used to adjust the angle of the spray emitted from the shower nozzle, but rather to adjust the height of the nozzle assembly.

U.S. Pat. No. 5,329,651 issued to S. G. Marder et al. on Jul. 19, 1994, entitled "Bathing Apparatus for the Infirm", discloses a shower stall unit specifically arranged to be easily used by the infirmed or elderly including various handles, a seat, a pivotable support bar, and a shower nozzle connected to a hose at a fairly low height. The shower nozzle arrangement includes a swivel mounted on a support member, a handle, a shower mast and a nozzle. Moving the handle and swivel member causes the spray nozzle to move rearwardly and forwardly in relation to the bather, enabling the bather to rinse his or her entire body without physically moving around. Marder incorporates a continental-type of hand-held showerhead into an overall arrangement for bathing elderly or inferior persons.

U.S. Pat. No. 5,499,767 issued to M. Morand on Mar. 19, 1996, entitled "Shower Head Having Elongated Arm, Plural Nozzles, and Plural Inlet Lines", discloses a showerhead having an elongated arm attached thereto with a swivel joint connected to the back of the arm, and the showerhead connected to the front of the arm. Spray from the nozzle can be directed by grasping the lower end of the arm near and then pivoting and/or tilting the arm about the swivel joint. In other embodiments, a control valve is provided in the arm for turning the water on and off, a second shower nozzle is provided on the bottom end of the arm, and a third nozzle is provided in the middle of the arm. A variable spray arrangement is also disclosed.

U.S. Pat. No. 6,315,220 issued to T. L. Grubb on Nov. 13, 2001, entitled "Method and Apparatus for Converting a Faucet to a Hand-Held Shower", discloses a flexible hose apparatus which is connected to a shower head so that it may be used as a hand-held shower rather than a conventional shower. Grubb thus basically attaches a continental showerhead attachment for an American shower system.

U.S. Pat. No. 6,474,621 issued to J. Vogel on Nov. 5, 2002, entitled "Water Control Apparatus for Showers", discloses a valve assembly connected between a showerhead and a water source and also including a downwardly extending operating means in the form of a rod for adjusting the flow of water without using the conventional hot and cold taps. Vogel claims that this arrangement conserves water by decreasing wasted water during use, and generally discloses a downwardly extending handle connected to a shower assembly for adjusting the amount of spray, rather than the direction of the spray.

U.S. Pat. No. 6,618,872 issued to C. Fan on Sep. 16, 2003, entitled "Controlling Device for a Showerhead", discloses a shower head including a push valve, a controlling valve, and a collar for aiding a short person or child in controlling the shower head. The showerhead assembly has a first water outlet leading to a shower nozzle and a second outlet leading to a water dispenser. The push rod is used essentially to control the path of water into either the first outlet or second outlet. While the Fan reference teaches a downwardly extending control rod connected to a shower assembly, the rod is not used to change the direction or angle of the spray emitted from a shower nozzle, but rather to control the path of the water through the shower assembly.

U.S. Design Pat. 360,022 issued to L. A. Smith on Jul. 4, 1995, entitled "Combination Bathtub and Shower Unit and Seat for Handicapped and Elderly Persons", shows an ornamental design for a shower assembly having a seat and a manual shower hose.

None of the aforementioned references or any prior art with which the present inventor is familiar includes the use of an extended pivoting rod or handle which may be used to control in one embodiment the direction of the water issuing from the showerhead by a disabled person in a sitting position in a bathtub and shower installation and in another embodiment the force of such water and preferably also the temperature of such water, which can be pivoted out of the way when not in use so that the shower assembly can be used in a conventional manner. Nor are there any arrangements which can be easily and inexpensively substituted for or attached to an existing shower system.

OBJECTS OF THE INVENTION

It is an object of the invention, therefore, to provide an extended arm or handle apparatus attached to a pivoting showerhead in a shower installation for operation by the physically challenged including the elderly or disabled which can be grasped by the person using such shower from a seated position to control the direction of the showerhead and therefore the direction of the shower water, and which can be pivoted downwardly out of the way when the shower is to be used by others.

It is still further object of an embodiment of the invention to provide a showerhead directional control apparatus having an elongated showerhead attachment arm for use by the elderly, physically challenged or disabled that can also be used conveniently by non-disabled persons by simply pivoting the control arm out of the way.

It is a still further object of and embodiment of the invention to provide a shower directional control apparatus which can be easily substituted for an existing showerhead installation and provide convenient effective showering by disabled, elderly or otherwise physically challenged persons in private while seated as well as by a non-disabled person standing in the shower in a normal position.

It is a still further object of the invention to provide a shower assembly incorporating an extended handle which enables the user not only to adjust the direction of the showerhead, but also in an embodiment the force or temperature of the shower water.

It is a still further object of an embodiment of the invention to provide an elongated arm for attachment to a showerhead which is capable of being set in a plurality of use positions.

It is a still further object of an embodiment of the invention to provide a showerhead directional control assembly having a plurality of attachment points reducing the pulling and sheering forces placed on the outlet pipe to which the showerhead assembly is connected, and allowing for more precise adjustment of the location of the attachment arm when in an extended position.

It is a still further object of an embodiment of the invention to provide a showerhead attachment arm assembly including a wall bracing member to facilitate prevention of the outlet pipe from being pulled in relation to the shower stall wall.

Other objects and advantages of the invention will be evident from review and study of the following designation in confirmation with the appended drawings.

BRIEF DESCRIPTION OF THE INVENTION

A showerhead directional adjustment and control apparatus and assembly is provided featuring an extendable handle for allowing the direction of the showerhead and, therefore, the spray direction issuing from said showerhead, to be varied by a person seated in the shower, the handle being sufficiently long or extended to be easily graspable by a physically challenged person who finds it either necessary or desirable by reason of being elderly or otherwise disabled or partially disabled to shower from a seated position in a shower, but which handle can be pivoted out of the way when the shower is used by a more physically normal person who does not require use of the handle. The extended handle in an embodiment it will remain extended while being used by a disabled person, which extended position can be adjusted, but can also be swung away when not in use and such shower is used by another. In an embodiment an elongated rod is housed in the extendable handle member, which rod is longitudinally movable and positioned such that one end of the rod can extend outwardly through an opening in the handle to engage in a complementary recess in a stationary portion of the handle apparatus secured to a showerhead. A finger latch is provided on the outer end of the handle which is connected to the longitudinal rod and allows the user to easily release the handle so it can be pivoted to a different position. An adjustable bracket allows the position of the handle to be more precisely adjusted, and further strengthens the connection of the assembly to a water supply pipe. The present invention therefore will provide seated persons with a greater degree of independence during showering, and also may serve as a safety device by enabling the user to redirect the water spray from their body quickly in the event of unexpected changes in water temperature.

DESCRIPTION OF THE PREFERRED EMBODIMENTS

Figure 1:
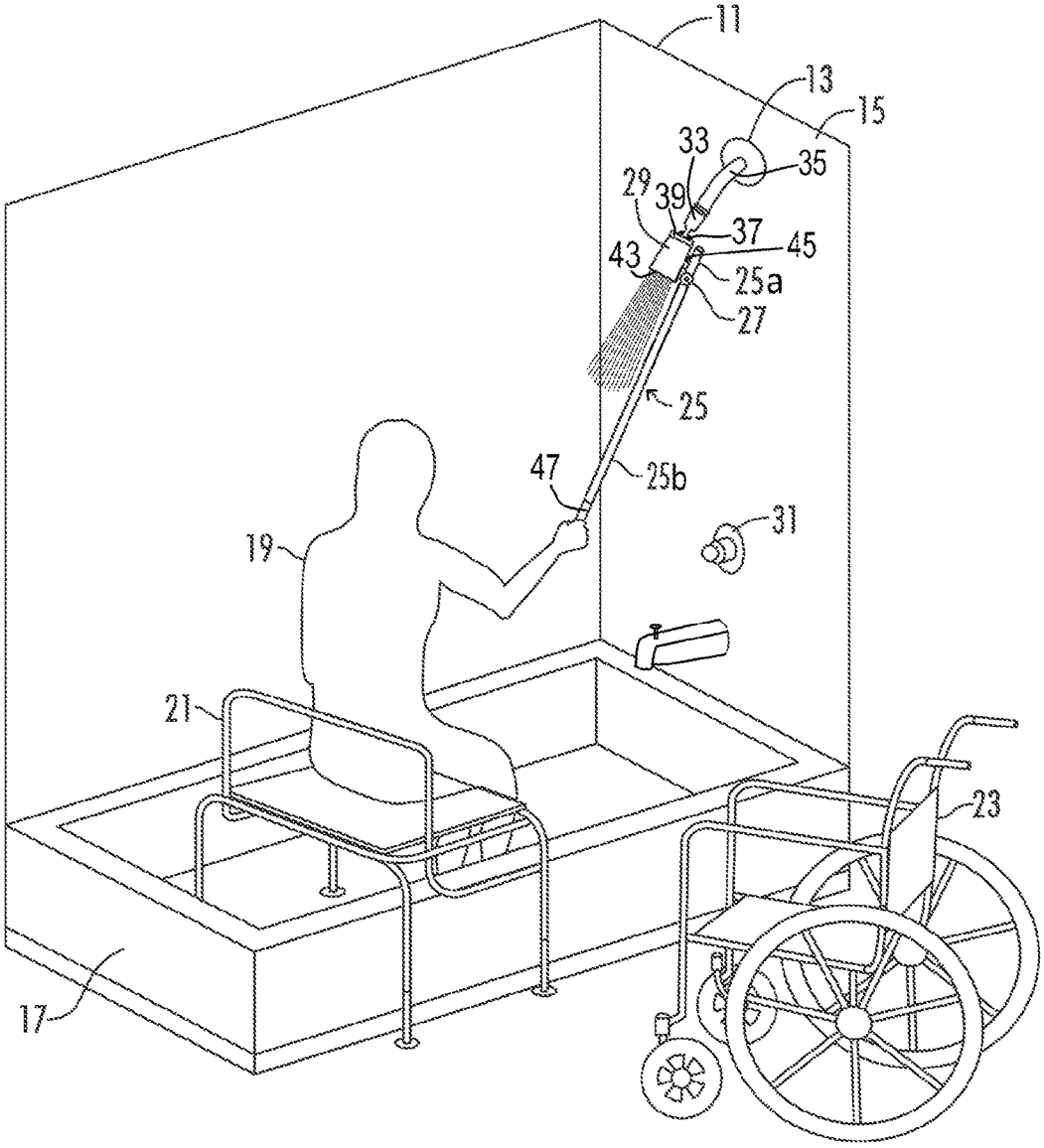
FIG. 1 is an isometric view of a shower installation incorporating an embodiment of the showerhead control handle assembly of the invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Elderly, disabled or otherwise physically challenged individuals who cannot stand either at all or who are unsteady and cannot stand and move securely in a shower or a tub equipped with a shower whether by reason of physical weakness or because of diminished balance are usually forced to sit on a stool or a chair of some sort in the shower enclosure. However, in a sitting position such persons frequently cannot reach the usual controls of a shower assembly, including not only the water flow controls but also the showerhead, which is typically pivotably connected to the exit or discharge end of a water supply pipe and which can be manually rotated to adjust the direction of water discharged from the showerhead, and as a result must rely upon others to adjust the shower controls or risk falling in attempting to adjust them themselves. Almost all persons, however, value their privacy and independence when bathing and do not like to be hovered over by aides of any nature particularly in the usual nude condition necessary for showering. Taking a shower, moreover, is one time when most individuals enjoy relaxing alone with their own thoughts while having their body and mind stimulated by the pleasurable feel of water flowing over it. The elderly, incapacitated and otherwise physically challenged, furthermore, value highly anything that aids or preserves their independence, such as walkers, scooters for the elderly and disabled, lift chairs and the like, but even more valued is being able to tend to their own physical requirements such as eating and washing and last if certainly not least "going to the bathroom" or attending to important elimination functions. Being able to attend unaided to these needs truly does wonders for the attitude and peace of mind of such persons.

As a result there have been numerous inventions and developments to aid the elderly, disabled and physically challenged to bath and shower safely and conveniently such as hand hold bars on the sides of tubs, non-slip mats and other surfaces in the tubs, and arrangements by which the shower water can be controlled by one seated in a shower which is typically arranged in connection with a tub. Such installations are frequently not inexpensive and frequently also render the shower installations unsuitable for normal users. It is the present inventor's aim, therefore, to provide an apparatus for allowing easy control of the direction of water spray emitted from a showerhead by one seated on a chair or on a stool in a shower stall or tub, which is both inexpensive and effective to allow the seated showerer to directionally align the showerhead to direct the water spray over his or her whole body in increments, allowing such person to soap or lather other parts of his or her body by changing the angle of the showerhead by means of an extended arm or handle connected to the showerhead away from the body part or area being lathered and then when desired redirecting the water spray at such body part or area to wash away the soap or lather. In addition, the arm or handle may be pivoted between one or more use positions and a nonuse position in which the handle is swung out of the way of a person who is able to stand to take a shower in the same installation without any modification. In simpler embodiments, the adjustment arm of the invention may be connected to a conventional pivotable showerhead, while in a preferred embodiment the showerhead control assembly is provided as a replacement unit for an existing showerhead incorporating a built-in pivoted adjustment lever attached to the showerhead assembly which allows for more precise control of the positioning of the handle.

Use of the invention therefore provides a simple and practical method for one seated upon a chair or stool in a shower to easily control the direction of water spray being emitted from a showerhead, and as a result vary the location on the body the water spray is being directed by operating the device to pivot the showerhead in any direction it is capable of being pivoted, and in one embodiment to both turn on the shower themselves once seated in the shower and to turn off the shower when their private ablutions, or washing, is complete prior to opening the shower curtain or enclosure preparatory to obtaining the aid of another to physically leave the shower area. The pivotable nature of the shower handle will further allow the handle to be alternatively positioned in either one or more extended use positions, or in a nonuse position pivoted out of the way of those who can reach the showerhead and control the direction of the water spray manually. In a preferred embodiment, a rod is provided extend longitudinally in the pivotable handle section which selectively interengages with a base section in order to secure the handle section in an extended position ready for use by a showerer seated on a shower chair, which initial extended position may be adjusted, or in a nonuse position pivoted to a position substantially in parallel with a wall of the shower or tub enclosure.

In FIG. 1 there is shown an isometric view of a tub type enclosure 11 partially surrounding a tub 17 in which a shower installation 13 is mounted on a wall 15 of the enclosure 11. It will be understood that a shower curtain or a sliding door enclosure well known in the art will usually be mounted along the otherwise open side or sides of the tub to limit shower spray beyond the confines of the tub or shower area or enclosure, but which curtain or door arrangement is not shown in FIG. 1 for convenience of illustration of the invention. A showering individual 19 is shown seated on a light seating device or chair 21 placed in the tub 17. It will be understood that an aide of some nature, such as a family member, neighbor, nurse or the like, not shown, has probably, but not necessarily, helped the individual 19 into the tub 17 and will aid him or her in egression or leaving the tub and shower enclosure. While in the tub-shower installation, however, the individual can usually be left completely or at least substantially to his or her own resources in washing, and in operating shower arm 25, shown in FIG. 1 being grasped by the individual 19, to pivot showerhead 29 as needed to vary the angle of the showerhead 29 and therefore the direction of the water spray being emitted from the showerhead 29 and the location on the body of the individual 19 the shower spray is being directed. In this embodiment, the water flow and temperature may be initially adjusted by the aide, leaving the particular directional aiming of the showerhead to the showering individual through the shower arm 25. The showerhead control arm 25 may be used by the showering individual 19 to control the movement of the showerhead 29 and direct the water spray from side to side and up and down so that essentially all positions of the body of the seated individual 19 can be reached by the shower water spray. Preferably the seat of the light seating device or chair 21 will be of a construction which will allow water to reach the posterior of the individual if not by a direct spray, at least by a run off flow of moisture. The showerhead 29 may also be pivoted using control arm 25 so that the water spray is not directed on the individual's body, for example, if the water temporarily becomes too hot or cold during showering, or during times when the individual 19 is applying soap to his or her body. The showerhead 29 thus may be pivoted using the control arm 25 to any position within the range of motion of the showerhead 29 and its connection to the shower installation 13.

The control arm 25 of the shower installation 13 may be placed in the hand of the showering individual 19 when first seated in the shower, or as shown in later Figures may be secured in an extended use position prior to the individual 19 entering the enclosure 11. Control arm 25 will be preferably hinged at a pivot joint 27 such that two parts or sections, namely inner section 25*a* and outer section 25*b* are formed and outer section 25*b* will be able to swing or rotate in an arcuate fashion or single direction with respect to section 25*a* so that ready control of the position of the showerhead 29 by a seated individual can be attained. Depending upon the height of the seated individual and how far he or she is positioned from the showerhead, he or she will be able to grasp the outer section 25*b* of arm 25 and with the application of relatively little manual force easily move the arm from side to side or up and down, causing the showerhead to similarly pivot. The outer section 25*b* of the control arm or shower arm 25, furthermore, is pivotable at joint 27 so that it can be pivoted downward to a substantially vertical position out of the way of a normal standing showering individual. The pivot point 27 of control arm 25, therefore, will normally be at a location near where the arm is connected to the showerhead 29 such that outer section 25*b* is substantially longer than inner section 25*a*, which will facilitate the outer section 25*b* being in close proximity to the wall 15 when pivoted into non-use position substantially in parallel with wall 15, thus ensuring that outer section 25*b* is not in the way of an individual wishing to take a shower without using the control arm 25. Inner section 25*a* of the shower arm 25 is preferably attached to the showerhead 29 on the underside of such showerhead so that the showerhead 29 can be moved by use of the control arm 25 when such arm is moved, but will not interfere with the flow of the shower spray when folded down during use of the shower by a standing individual taking a shower. Less preferably, the shower arm 25 could be attached to either side of the showerhead 29.

Figure 2:
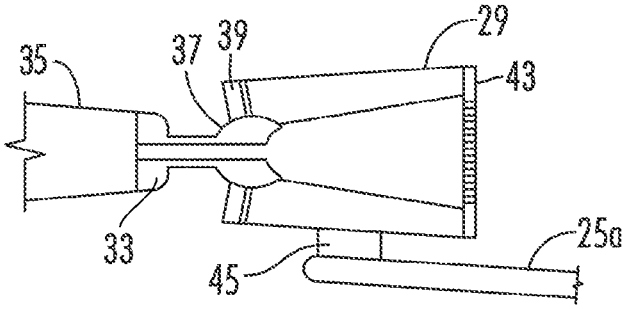
FIG. 2 is a cutaway view of a showerhead equipped with the control handle shown in FIG. 1 in a first position.
Figure 3:
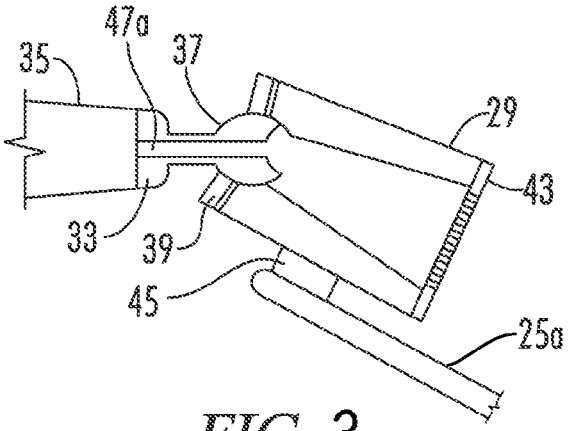
FIG. 3 is a cutaway view of the showerhead shown in FIG. 2 in which the showerhead is inclined downwardly.

As shown in FIGS. 2-3 which illustrate the showerhead 29 in a non-pivoted and pivoted position, respectively, the showerhead 29 is secured to a shower coupling 33 which is connected to supply pipe or water conduit 35 extending usually from wall 15. The shower coupling 33 has fixed to the end opposite conduit 35 either integrally or as a separate piece, a ball 37 including a water outlet or port which ball is grasped or partially encompassed by an internal socket in the rear end of the showerhead 29, in combination with a retainer 39 threaded on to the rear of the showerhead 29, such that the water outlet opens into a chamber in the showerhead 29 in a conventional manner and the showerhead 29 is allowed to be universally pivoted or inclined with respect to or about the shower ball 37. A perforated shower disk 43 provides a screen at the outlet end of the shower head 29 to partially close off the chamber within the showerhead, which chamber supplies shower water under pressure against the back of the perforated shower disk 43. When an excess of water pressure builds up in the chamber, separate water streams are ejected from the front of the showerhead 29 when turned on, the force and diameter of such individual shower streams being proportional to the size of the orifices in the perforated disk 43 and the back pressure in the showerhead water chamber.

Inner or proximal section 25*a* of pivoting shower adjustment arm 25 is preferably rigidly attached to or integrated with the showerhead 29 through a bracket 45, and 25*b*, constituting the outer or distal portion of the adjustment arm 25, the end or extreme distal end of which will be grasped by the shower user, see FIG. 1, to control the inclination of showerhead and will during nonuse of the shower or during showering by an individual who is not physically challenged, be pivoted straight downwardly. A rubber or other flexible or soft cushioning end 47 (see FIG. 1) may be provided on the end of the outer or distal portion 25*b* of the adjustment and operating arm 25 to aid the user in grasping and retaining a grip on the arm 25.

Figure 4:
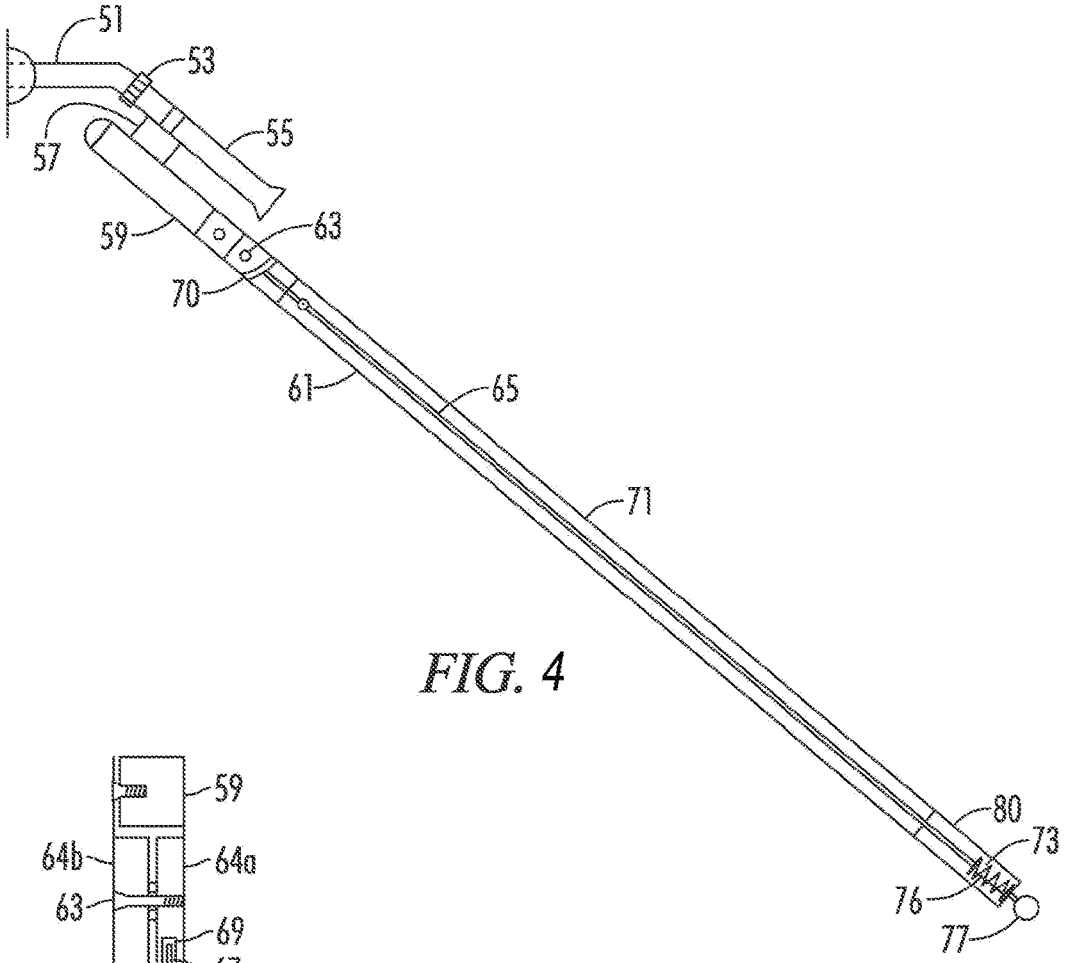
FIG. 4 is a side partially cutaway view of another embodiment of the showerhead control handle assembly of the invention.
Figure 5:
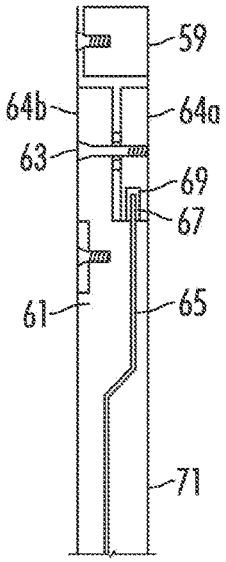
FIG. 5 is a partial top view of the control handle shown in FIG. 4 illustrating the pivot and locking arrangement.

FIG. 4 is a side partially cutaway view of an alternative embodiment of a showerhead directional control assembly equipped with a showerhead adjustment arm in accordance with the present invention in which the lower adjustment arm section is formed in an embodiment of a thin metal or plastic rod pivotably secured to an upper section, which upper section is secured to a more linearly designed showerhead than illustrated in the previous figures. More particularly, the showerhead 55 is pivotally connected to a wall mounted shower supply pipe 51 having an approximately forty-five-degree downward curve near its outer end by a coupling 53. A mounting bracket 57 is connected to showerhead 55, which bracket 57 is mounted in turn to upper or stationary arm attachment member 59, and lower or movable arm attachment member 61 is pivotably attached to upper arm attachment member 59. The upper and lower arm attachment members 59 and 61 may be formed of a sturdy plastic material such as polyurethane, acrylic plastic, or other suitable material such as stainless steel which is resistant to degradation by water or air. Members 59 and 61 are pivotably connected together or with respect to each other by means of a stainless-steel pivot bolt 63 (see also FIG. 5) passed laterally through mating ends 64*a* and 64*b* of members 59 and 61. In addition, a stainless-steel rod 65 is housed in a longitudinally extending passageway in tubular member 71 of movable arm attachment member 61, and is secured to be longitudinally movable within the passageway so that one end 67 can pass outwardly through an opening in the end of attachment member 61 pivotally connected to stationary member 59. As shown in FIG. 5, end 67 of rod 65 is oriented so as to extend into a complementary recess 69 in the end 64*a* of the stationary arm attachment member 59 when stationary attachment member 59 and movable arm attachment member 61 are vertically aligned with each other, thereby securing attachment member 61 in an extended use position as shown in FIG. 4. The intersection 70 between the stationary attachment member 59 and the moveable attachment member 61 is complementarily curved to allow the moveable attachment member 61 to rotate on its pivot 63 about the stationary attachment member 59 when end 67 of rod 65 is not extended into recess 69 in stationary attachment member 59.

As best shown in FIG. 5 a short section of the stainless steel rod 65 in the illustrated embodiment spaced from end 67 is bent or angled inwardly to bring rod 65 preferably towards the center of tubing member 71 comprising part of moveable attachment member 61. As shown in FIG. 4, a stop rod 76 is mounted to the outer or lower end of rod 65 in tubular member 71, the outer end of which stop rod 76 extends through an opening on the lower end of tubular member 71. A tension member such as coil spring 73 is secured over stop rod 76 in order to continually urge opposite end 67 of rod 65 towards the upper end of tubular member 71 as shown in FIG. 5. In addition, a ring member 77 or other hand grasping member is secured to the outwardly extending end of stop rod 76 which ring member can be grasped by the user and pulled outwardly which will cause rod 65 to move longitudinally in the passageway within tubular member 71 until end 67 of rod 65 is released from recess 69 of the stationary arm attachment member 59, allowing tubular member 71 to freely pivot. A nonslip gripping member or handle 80 is also provided over the end of tubular member 71 near ring member 77.

Figure 6:
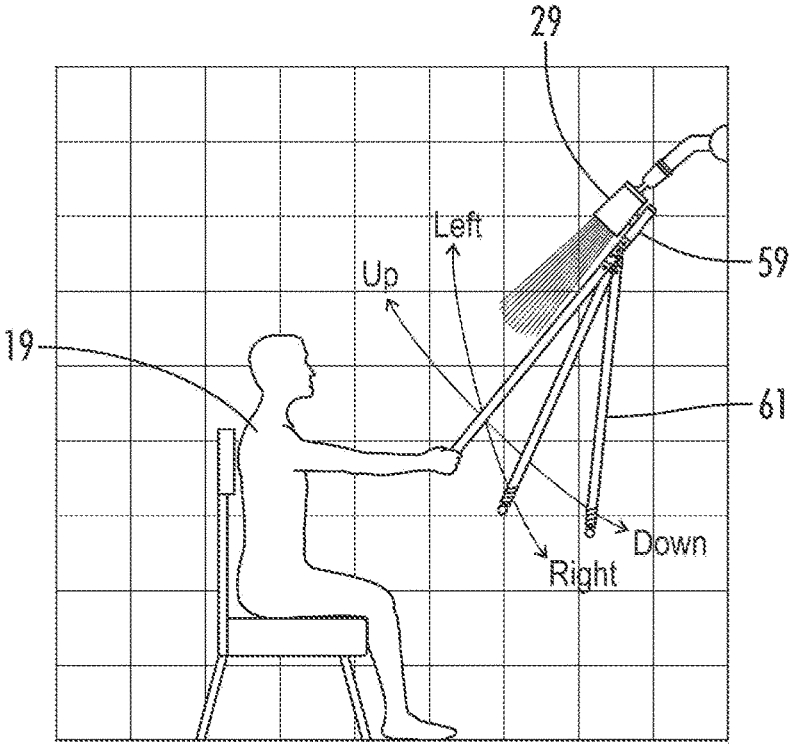
FIG. 6 is a diagrammatic side view illustrating use of the shower handle assembly of the invention by an individual sitting in a chair within a shower enclosure to control the position of a showerhead.

As may be readily perceived the moveable attachment arm 61 including the stainless rod 65 and the outer stainless tubing 71 when rod 65 is unlocked or released from upper portion 59 will normally be caused to pivot downwardly by the influence of gravity at pivot point 63, but will also be light and easy to pivot manually into an extended position and then secure in such position ready for use by a seated individual taking a shower as shown in FIG. 6, which is a diagrammatic representation of the lower portion of the handle or attachment arm 61 being in such diagrammatic representation held by an individual 19 taking a shower while seated on a light chair as shown also in FIG. 1. In addition, when released by the individual, the handle or attachment arm 61 when locked will remain in an extended position within reach of the seated individual 19, so that the attachment arm does not have to be continually grasped by the user to keep it within reach, and when unlocked may be swung down to be in an out of the way vertical position as shown in FIG. 7 again in diagrammatic form so that an individual who is not physically challenged can take a stand-up shower with the shower handle hanging downwardly out of the way.

Figure 7:
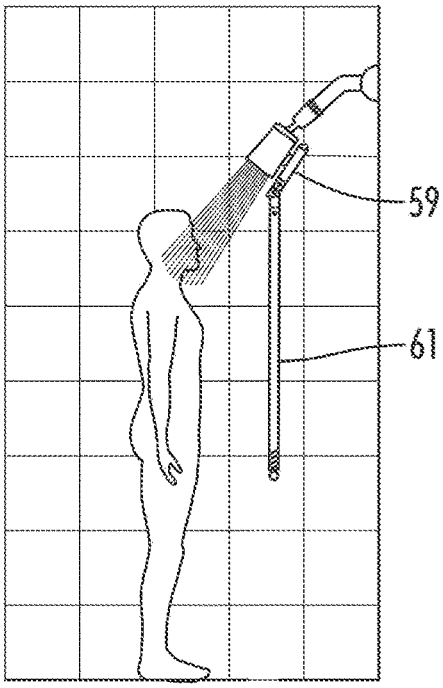
FIG. 7 is a diagrammatic side view of a typical physically unchallenged individual standing in a shower enclosure with the shower handle hanging down or dependent out of the way during such individual's shower ablutions.

Diagrammatic FIG. 6 also includes directional arrows indicating that handle 61 can be operated by the seated physically challenged individual 19 to pivot the showerhead 29 up, down, to the left, or to the right or any angle in-between as desired, and when disengaged from the upper portion 59 can be swung down out of the way to enable use of the shower by an individual as shown in FIG. 7 who is physically unchallenged. The direction of the shower spray thus can be varied to by the showering individual so as to contact the individual either more on their left side or right side, or head, upper, or lower torso as desired in order to provide a thorough washing and rinsing of the entire body.

As will be understood from the above description and the appended drawings, the arrangement of the invention provides a very effective yet relatively inexpensive arrangement for adapting a standard shower for use by a physically challenged individual who nevertheless prefers to shower without the aid or assistance of others, at least during the actual bathing or washing process. While it might be thought that providing a pivot connection in the handle which serves to control the direction of the showerhead, and therefore the direction of water flow from such showerhead, would be undesirable due to unwanted bending or pivoting of such handle while controlling the direction of flow or the flow by inclination of the showerhead, in actuality it has been found that, while a universal pivoting arrangement might well provide difficulty, a single direction pivot causes minimal difficulty, since the connection from the hand controlled end of the directional control rod to the end attached to the showerhead can be either applied transversely to the pivot joint or can be partially pivoted and pressure or force from the end applied through the pivot joint against the end of the other section of handle at an angle with such section in which case the two way cross linkage or pivoting linkage serves as a lever arm to increase force applied to the showerhead. In addition, due to the normal position of the showerhead at a higher point on the wall of the shower installation than the sitting user's hand, an upward or downward force on the handle can easily be applied to adjust the angle of the showerhead and water spray without the handle being caused to pivot substantially at the pivot joint, even without any additional means for maintaining the outer handle section in an extended use position, although this is preferred so the handle is maintained in a reachable location for the seated individual. It has been found that average disadvantaged persons learn the necessary hand moves to accomplish such control amazingly quickly and no difficulty has been encountered with physically challenged individuals learning the necessary hand movements to control directed orientation of the showerhead.

Figure 8:
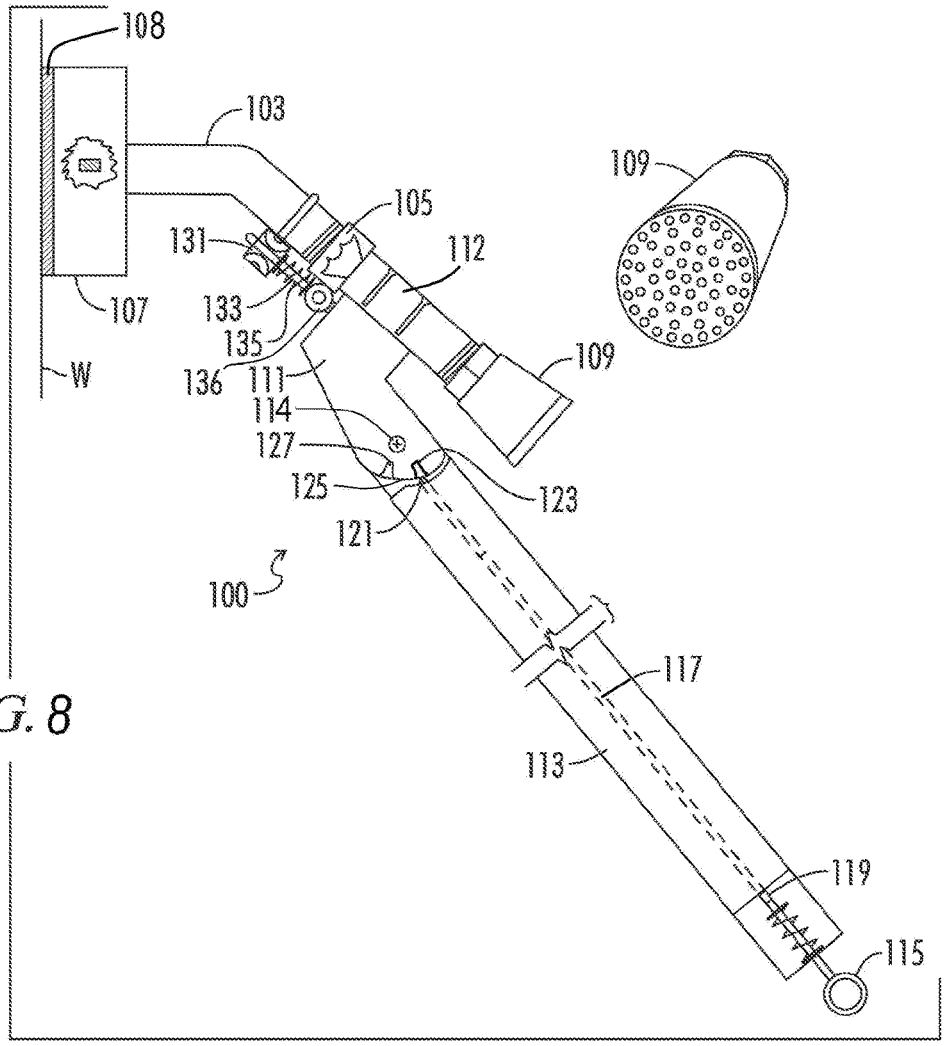
FIG. 8 is a diagrammatic view of another embodiment of the showerhead control handle assembly of the invention.
Figure 9:
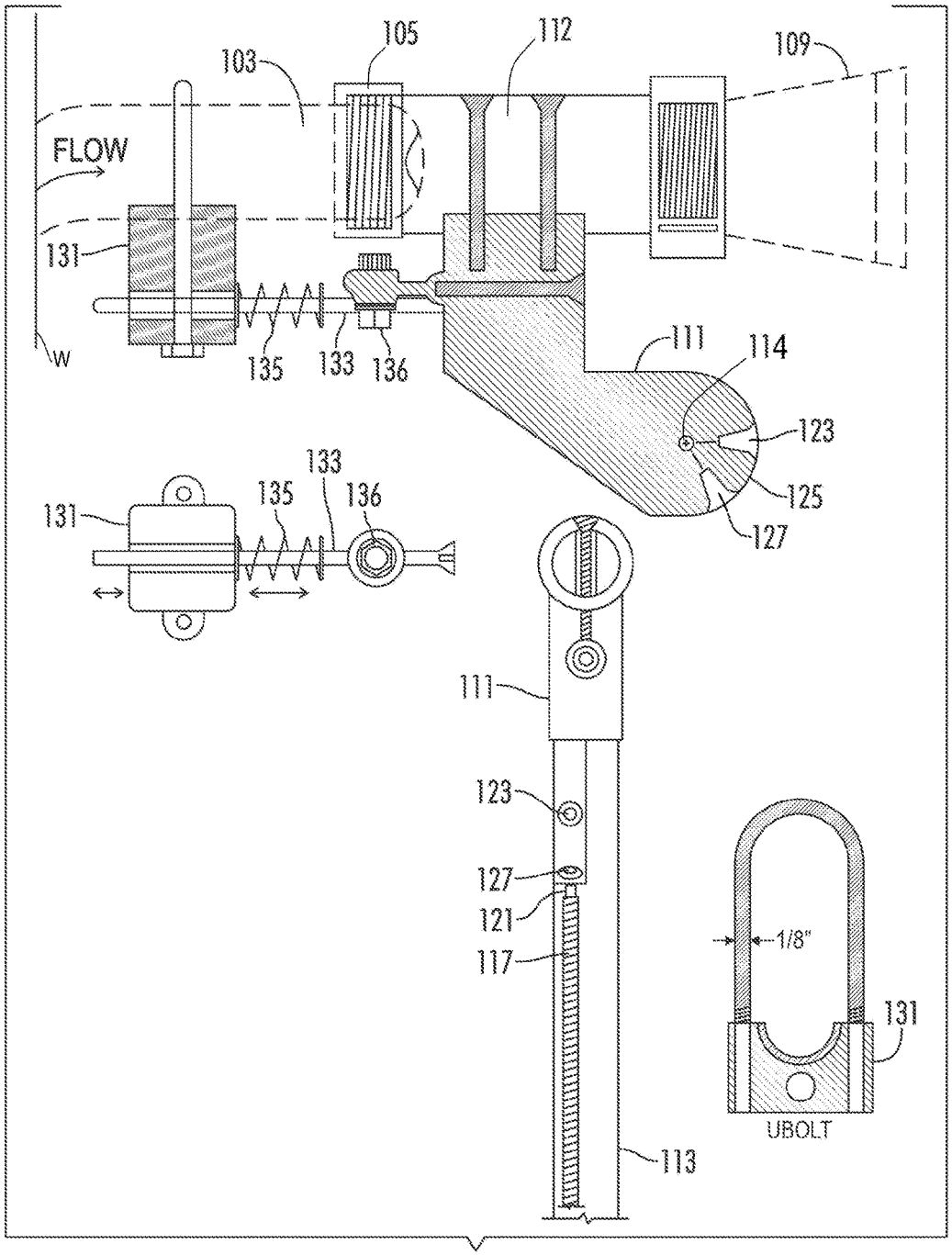
FIG. 9 illustrates several components of the embodiment shown in FIG. 8.

FIGS. 8-9 illustrate another embodiment of the shower directional control apparatus of the invention, in which the apparatus is shown attached to a water supply pipe 103 on the end of which a ball type connecting fitting 105 is provided. A screw-tightened locking clamp or wall pipe support 107 (see FIG. 8) is also provided, and is secured around a portion of the water supply pipe 103 adjacent wall W. The inner surface of pipe support 107 is secured to wall W by a tac rubber 108 or other material such as a putty or adhesive applied to aid in maintaining a tight connection with the wall. Clamp or pipe support 107 aids in preventing supply pipe 103 from pivoting or being pulled out of wall W due to the additional weight and stresses exerted on pipe 103 resulting from use of the showerhead handle control apparatus 100 of the invention. More particularly, handle apparatus 100 includes an L-shaped mounting section 111 which is permanently coupled to conduit 112 by bolts or the like. Conduit 112 is pivotably connected on one end to ball fitting 105 and on the other end to showerhead 109 such that pivoting of conduit 112 will resultingly cause showerhead 109 to also pivot and adjust the direction of the water spray. In addition, attachment arm 113 is pivotably secured to an end of mounting section 111 by a pivot bolt 114. As in the embodiment described above with reference to FIGS. 4-5, attachment arm or handle 113 includes a spring-loaded gripping member such as finger latch or ring 115 which is indirectly connected by a stop rod or connector 119 surrounded by a coil spring 120 to an internal rod 117 extending longitudinally through handle 113. The end or tip 121 of the internal rod 117 is oriented to extend out of the forward end of the attachment arm 113 through an aperture and to be inserted into one of the recesses 123 and 127 in mounting section 111. Recesses 123 and 127 are spaced apart along an appropriately rounded edge 125 of mounting section 111 and thus are situated at different angles, such that when the end 121 of rod 117 is engaged in one of said recesses 123 and 127, the pivoting handle 113 will be locked against pivoting in a desired use or non-use angle simply by pivoting the handle 113 on hinge or pivot connection 114 with respect to mounting section 111 and then releasing finger latch 115 so that end 121 extends into the selected recess 123 or 127. Additional recesses at other desired angles may be provided in mounting section 111 to accommodate different user needs. By grasping and pulling the finger latch 115 against the bias of the spring of connector 119 and then releasing latch 115 the connection of the arm 113 with the mounting block 111 may be established or disestablished. This procedure may be easily carried out by a disabled person while sitting in a tub on a bath seat.

Referring still to FIGS. 8-9, adjustable bracket 131 is secured by a clamping means or other arrangement to the downwardly angled section of inflow pipe 103 and to mounting section 111. Bracket 131 includes a rod member 133 having an end that extends into an aperture (not shown) in mounting section 111. A coil spring 135 is provided over a portion of rod member 133, and a knob means 136 is provided over the rod member 113 for adjusting the position of rod member 133 and locking the rod member in such position. By adjusting the position of the rod member 133, the initial or resting angle of pivotable conduit 112 with respect to ball fitting 105 can be set and/or adjusted. As a result, the angle of showerhead 109 and attachment arm 113 is also precisely adjusted, since bracket 131 will prevent the conduit 112 from pivoting beyond the set position. By adjusting the length or position of rod member 133 of bracket 131, the initial extended or use position of the lower end of attachment arm 113 can be varied up to about two inches. In addition, bracket member 131 limits the range of movement of conduit 112 and as a result of attachment arm 113 so arm 113 is maintained in an easily reachable position for the seated user. An additional benefit of bracket member 131 is that the amount of stress exerted on the components of the invention, including the connection between water supply pipe 103 and ball fitting 105, as well as between ball fitting 105 and conduit 112, is substantially reduced, in addition to the stress reduction provided for supply pipe 103 by wall mount 107. It will be understood that when the handle 113 is utilized to vary the direction the showerhead 109 is pointing, a large percentage of the stress of such twisting which would otherwise be exerted on the inflow pipe is redirected through bracket member 131, and away from the wall connection of the inflow pipe. As a result, provision of bracket 131 results in significantly less wear or stress on inflow pipe 103 and thus prevents loosening, cracking of such pipe, which it has been found may become so loose as to leak or even become completely dislodged, which it will be immediately evident could result in significant water damage occurring.

Figure 10:
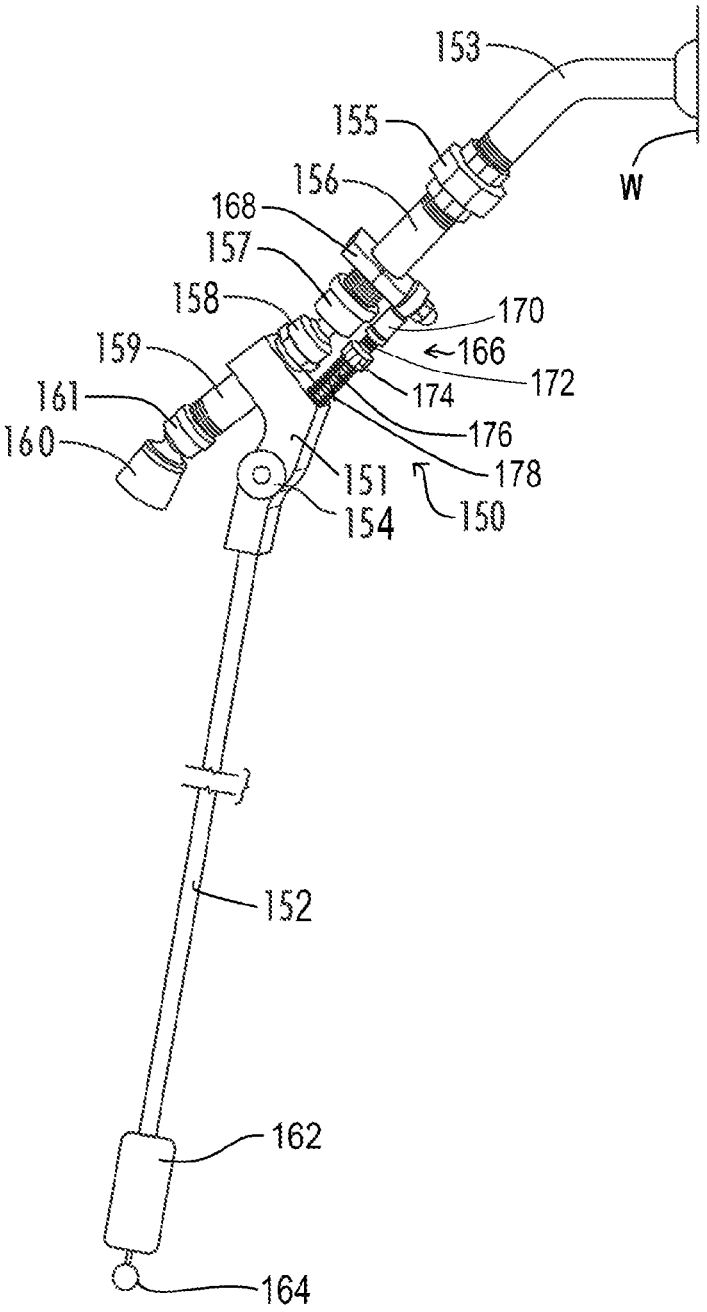
FIG. 10 is an isometric view of another embodiment of the showerhead control handle assembly of the invention.
Figure 11:
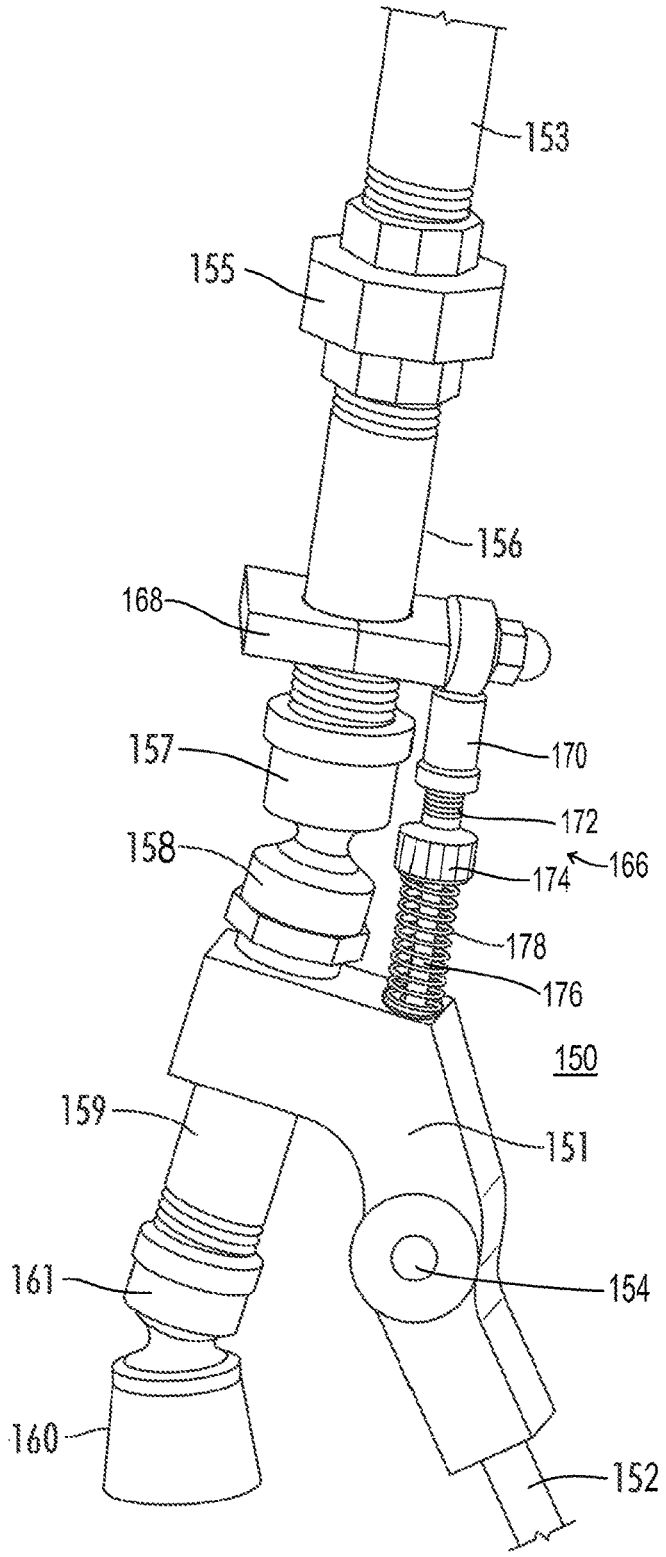
FIG. 11 is a close-up view of the showerhead assembly portion shown in FIG. 20.

FIGS. 10-11 illustrate another embodiment of the showerhead control handle or arm assembly 150 of the invention, with the entire shower arm represented in FIG. 10, and details of the shower fitting assembly leaving out the shower arm illustrated in FIG. 11. It will be noted that the assembly 150 shown in FIGS. 10-11 has been designed to be preferably manufactured and installed as a single unit which is connected to a water supply pipe after removal of the existing showerhead from the supply pipe. As in the previously described embodiment, assembly 150 includes a mounting section 151 and an elongated handle or attachment arm 152 which is pivotably secured to mounting section 151 by a pivot bolt 154. Water supply pipe 153 which is threaded on its open end extends from wall W. Assembly 150 also includes a female coupling 155 which is threadably secured on an end to water supply pipe 153, and on the other end is threadably secured to conduit member 156. In addition, a coupling 157 having a ball fitting 158 is connected to the other end of conduit member 156, and an end of another conduit member 159 is connected to ball fitting 158. Showerhead 160 including ball fitting 161 is then secured to the outer end of conduit 159. Ball fitting 161 allows the angle or direction of showerhead 160 to be manually adjusted as needed by a person using the shower in a normal standing position without disturbing the other components of the shower assembly 150.

Mounting section 151 is clamped over conduit 159 such that movement of handle 152 will cause conduit 159 as well as showerhead 160 to pivot on ball fitting 158, changing the angle or direction of water spray emitted from the showerhead 160. As in the previously described embodiment handle 152 is tubular and includes an internal rod (not shown) that is longitudinally slidable within the handle 152. A hand grip 162 is provided on the outer end of handle 152, and a finger latch 164 is positioned on the end of handle 152 which is pulled outwardly to release the handle 152 from the mounting section 151 so that the handle can be pivoted to a different position, also as described in the previous embodiment. Assembly 150 also includes adjustment bracket 166 which controls the extent of pivoting of handle 152 and allows the position of the outer end of handle 152 to be more precisely adjusted. Bracket 166 is secured on an end to conduit 156 by a clamping member 168. Member 170 is internally threaded and adjustably receives a threaded bolt 172 having a gripping portion 174. A rod member 176 is positioned on the opposite side of gripping portion 174 from bolt 172 and extends into an aperture in mounting section 151, and a coil spring 178 is positioned over rod member 176 between mounting section 151 and head portion 174 and continually urges mounting section 151 outwardly. Depending upon how far bolt 172 is threadably extended into member 170 by rotating head portion 174 in the appropriate direction, the extent that the opposite end of bolt 172 extends into the slot in mounting section 151 is adjusted, thus allowing the angle of mounting section 151 of assembly 150 and therefore showerhead 160 to be more precisely adjusted for the seated user.

Adjustment bracket 166 is similar to that in the previously described embodiment and in addition to allowing for precise position adjustment of the handle member, it serves to strengthen the overall shower control assembly, and in particular the attachment acts as a brace or support against which pivoting of the handle section and as a result the showerhead by the user causes the showerhead to pivot more easily and with less stress occurring on the water supply conduits. This arrangement thus achieves vastly superior results in terms of extending the lifespan of the assembly by allowing less wear on the pipe connections to occur as they are stressed by use of the shower handle, which stress is variable depending upon the flexibility and type of joints of the connections, but which nevertheless in all cases is significant.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A showerhead directional control apparatus for use by physically challenged individuals while seated on a shower or tub seat comprising:

a mounting section including a coupling for operably connecting the mounting section to a showerhead assembly, a handle section pivotally connected to the mounting section, the handle section being pivotable with respect to the mounting section between a nonuse position and at least one use position in which the angle of the showerhead upon a water supply pipe can be varied by a shower occupant seated upon the shower or tub seat by exerting a lateral or up and down force upon the handle section, the pivot of the handle section to the mounting section being through a horizontal pivot enabling the handle section to be moved into said nonuse position out of the way of a shower occupant using the shower in a stand-up shower mode, and a rod member mounted within a channel in the handle section and being slidable within the channel such that an end of the rod member can extend out of an end of the channel into a corresponding recess in the mounting section in order to secure the handle section against pivoting with respect to the mounting section.

2. A showerhead directional control apparatus in accordance with claim 1 additionally comprising an adjustment bracket connecting between the mounting section and a conduit member operably connected to the showerhead which allows for more precise positioning of the handle section in a use position while also reducing the range of motion of the shower head and amount of stress on the water supply pipe.

3. A showerhead directional control apparatus for use by seated individuals while showering comprising:

a mounting section including a bracket member for securing the showerhead directional control apparatus to a showerhead, an elongated handle section including an upper end and a lower grasping end, the upper end being pivotably connected to the mounting section by a pivot bolt and being pivotable with respect to the mounting section between a generally vertical nonuse position and an extended nonvertical use position, and a longitudinally extending passageway in the handle section having openings on said upper and lower ends, and a rod member slidably mounted in said passageway such that an end of the rod member can pass outwardly through the upper end opening into a complementary recess in the mounting section, said recess oriented such that the handle section is secured in a use position when the rod member is positioned in said recess.

4. The showerhead directional control apparatus of claim 3 additionally comprising another recess in the mounting section oriented such that the handle section is secured in a different nonuse position when the rod member is inserted in said recess.

5. The showerhead directional control apparatus of claim 4 additionally comprising a stop rod mounted to the rod member near the lower end of the handle section, said stop rod extending through the opening in the lower end of the handle section, and a tension member secured over the stop rod in said passageway which continually biases the rod member towards the upper end of the longitudinal passageway.

6. The showerhead directional control apparatus of claim 5 additionally comprising a grasping member secured to the outer end of the stop rod enabling users to pull outwardly on the stop rod in order to slide the rod member in the longitudinal passageway toward said outer end and release the handle section against pivoting with respect to the mounting section.

7. The showerhead directional control apparatus of claim 6 additionally comprising a hand grip provided over the grasping end of the handle section.

8. The showerhead directional control apparatus of claim 6 additionally comprising a first conduit member for securing said apparatus to a water supply pipe, and a second conduit member connected on one end to the first conduit member by a ball fitting and on another end to the showerhead, said first and second conduit members and ball fitting providing a water flow passage between the water supply pipe and showerhead, said mounting section being rigidly connected to the second conduit member, and a control bracket extending between the first conduit and mounting section for varying the use position of the handle section controlling the range of pivoting of the handle section, and providing additional support for pivoting of the handle section and mounting section on the second conduit member with respect to the first conduit member.

9. The showerhead directional control apparatus of claim 7 in which the control bracket is secured to the first conduit member by a clamping bracket.

10. The showerhead directional control apparatus of claim 9 additionally comprising a slot in the mounting section in which an end of the control bracket is received.

* * * * *